US007901338B2

(12) United States Patent
Gerschefske

(10) Patent No.: US 7,901,338 B2
(45) **Date of Patent: *Mar. 8, 2011**

(54) EXERCISE APPARATUS AND METHOD

(75) Inventor: Kevin Gerschefske, Springfield, MO (US)

(73) Assignee: Stamina Products, Inc., Springfield, MO (US)

( * ) Notice: Subject to any disclaimer, the term of this patent is extended or adjusted under 35 U.S.C. 154(b) by 763 days.

This patent is subject to a terminal disclaimer.

(21) Appl. No.: 11/396,913

(22) Filed: Apr. 4, 2006

(65) Prior Publication Data

US 2006/0252616 A1 Nov. 9, 2006

Related U.S. Application Data

(60) Provisional application No. 60/668,970, filed on Apr. 7, 2005.

(51) Int. Cl.
*A63B 26/00* (2006.01)

(52) U.S. Cl. ..... 482/142; 482/121

(58) Field of Classification Search ..... 482/121, 482/142, 72, 122–130, 91, 907; D21/676, D21/686, 690, 662
See application file for complete search history.

(56) References Cited

U.S. PATENT DOCUMENTS 339,638 A 4/1886 Goldie
382,319 A 5/1888 Norton et al.
1,996,350 A * 4/1935 Schaff ..... 482/96
4,077,623 A 3/1978 Clausell
4,477,070 A 10/1984 Appelbaum
4,564,193 A 1/1986 Stewart
4,706,953 A 11/1987 Graham
4,722,520 A 2/1988 Lee
4,836,530 A 6/1989 Stanley, Jr.
4,884,802 A 12/1989 Graham
4,911,438 A 3/1990 Van Straaten
5,066,005 A 11/1991 Luecke
5,071,115 A 12/1991 Welch
5,169,363 A * 12/1992 Campanaro et al. ..... 482/96
5,215,511 A 6/1993 Cheng
5,312,315 A 5/1994 Mortensen et al.
5,338,278 A 8/1994 Endelman
5,364,327 A 11/1994 Graham
5,445,583 A 8/1995 Habing
5,622,527 A 4/1997 Watterson et al.
5,634,870 A 6/1997 Wilkinson
D382,319 S 8/1997 Gerschefske et al.
5,788,606 A 8/1998 Rich
5,792,033 A 8/1998 Merrithew
5,897,459 A 4/1999 Habing et al.
5,938,571 A 8/1999 Stevens
(Continued)

*Primary Examiner* — Lori Baker
(74) *Attorney, Agent, or Firm* — Pillsbury Winthrop Shaw Pittman LLP

(57) ABSTRACT

An exerciser including a movable body support mounted on an exerciser frame for movement along tracks provided by the frame. A movable foot support extends from the exerciser frame. The movable foot support is adapted to be engaged by the user's feet to absorb the energy of movement in a first direction and to provide the user with a bouncing movement, which the user may translate into a movement of the movable body support in the opposite direction. The movable foot support may be provided as an attachment and retrofitted to existing exercisers, and, in some embodiments, may comprise independently movable foot supports for each foot. The exerciser may include a resilient resistance system coupled to the movable body support and a set of pull lines with user grips trained over pulleys carried by the exerciser frame. Also disclosed are methods for enabling users to exercise.

22 Claims, 7 Drawing Sheets

U.S. PATENT DOCUMENTS

| | | | |
|---|---|---|---|
| 5,967,955 | A | 10/1999 | Westfall et al. |
| 6,042,523 | A | 3/2000 | Graham |
| 6,135,922 | A | 10/2000 | Nissen |
| 6,186,929 | B1 | 2/2001 | Endelman et al. |
| 6,206,809 | B1 | 3/2001 | Habing et al. |
| 6,280,367 | B1 | 8/2001 | Arsenault |
| 6,338,704 | B1 | 1/2002 | Endelman |
| 6,371,895 | B1 | 4/2002 | Endelman et al. |
| 6,422,983 | B1 | 7/2002 | Weck |
| 6,500,099 | B1 | 12/2002 | Eschenbach |
| 6,527,685 | B2 | 3/2003 | Endelman et al. |
| 6,702,726 | B2 | 3/2004 | Lin |
| 6,752,745 | B1 | 6/2004 | Davis |
| 2002/0058573 | A1 | 5/2002 | Endelman et al. |
| 2002/0183172 | A1 | 12/2002 | Chen |
| 2004/0142800 | A1 | 7/2004 | Gerschefske |

* cited by examiner

EXERCISE APPARATUS AND METHOD

RELATED APPLICATIONS

This application is based on U.S. Provisional Application No. 60/668,970 filed Apr. 7, 2005, the entire contents of which is hereby incorporated by reference.

BACKGROUND OF THE INVENTION

1. Field of the Invention

The present invention relates to methods of exercising and to exercise apparatuses for carrying out those methods.

2. Description of Related Art

One of the consistent challenges in the fitness industry is devising exercise methods and apparatuses that allow the user to achieve maximum, diverse fitness effects by performing exercises in comfortable positions. For example, a type or set of exercises may be particularly attractive and beneficial to the user if it provides strengthening, toning and cardiovascular benefits. Exercise equipment used to perform fitness exercises should ideally be relatively simple in construction, flexible in the types of exercises allowed, and adaptable to a wide range of resistances and levels of exertion.

A popular type of exercise equipment provides a pair of generally parallel tracks, on which a carriage is mounted for sliding or rolling movement along the tracks. Depending on the particular variation, the carriage may be connected to a resistance system including one or more resilient members, such as springs or bungee cords, which bias the carriage towards a particular position. The carriage may also be connected to pull cords that are trained over a pulley system, allowing the user to move the carriage by pulling the pull lines. The user exercises with such an apparatus by using the arms or legs to move the carriage along the tracks.

Sliding-carriage multi-function exercise equipment of this type also typically includes a foot rest or foot bar which extends in a direction generally perpendicular to the rails. The foot rest or foot bar is operationally fixed in position, and allows a user to control the movement of the carriage by exerting his or her leg muscles against it. A foot rest typically includes a set of frame members or frame portions that are adapted to connect at a first end to either the rails of the apparatus or other appropriate structures provided for that purpose. At their respective second ends, the frame members are attached to a rigid member, such as a board. The board is typically covered with a layer of foam or other cushioning material, which may be enclosed in a layer of outer material, such as vinyl. The foam and outer material cushion the user's feet to some degree and provide traction.

A foot bar is a generally U-shaped and typically hollow bar that is adapted to be connected to the exercise apparatus at its ends. The top portion of the foot bar is covered with a traction/cushioning material. The user typically places his or her hands or feet on the cushioned portion of the foot bar to control the movement of the carriage.

One variation of the above-described type of exercise apparatus is disclosed in U.S. Pat. No. 5,967,955, which is incorporated herein by reference in its entirety. The disclosed apparatus includes a movable carriage mounted on generally parallel tracks and a foot rest of the type described above. The apparatus does not use resilient members to provide resistance; instead, resistive bias is provided by inclining the tracks at one of a number of angular orientations, thereby allowing the user to move the carriage by working against a corresponding fraction of his or her own weight bias under the influence of gravity using a pulley system that is coupled to the carriage. As the angular orientation of the carriage changes, the fraction of the user's weight bias changes correspondingly, such that at greater inclinations, the weight bias that the user works against is greater.

Another variation of the above-described type of exercise apparatus is that sold under the general name Pilates Performer™ (Stamina Products, Inc., Springfield, Mo., United States) for use with the Pilates exercise system. An apparatus of this type is shown in U.S. Pat. No. D. 382,319 to Gerschefske et al., the contents of which are incorporated by reference in their entirety. The apparatus includes a frame having a pair of generally parallel tracks that support a movable carriage which is mounted on the tracks with rollers for rolling horizontal movement along the tracks. A set of tensile resilient resistance elements is connected to the frame at one end and to the carriage at the other, thereby biasing the carriage towards a particular position. A pulley system and associated pull lines are coupled to the carriage, such that the carriage may be moved by application of force to the pull lines. A foot bar is provided at one end of the frame, and shoulder blocks are provided at one end of the carriage, allowing the user to position him or herself in a supine position to move the carriage against the resilient bias provided by the tensile resilient resistance elements using the muscles of either the legs or the arms.

There have been proposed in the prior art other types of exercisers that provide support for the user in a fixed seated position with a movable back support. See, for example, U.S. Pat. Nos. 5,215,511 and 5,897,459. Still others provide for fixed support of the user while on his or her back. See, for example, U.S. Pat. Nos. 6,206,809 and 6,500,099. U.S. Pat. No. 5,445,583 discloses two different exercisers. The FIG. 1-8 embodiment provides support for the user in a fixed seated position with a tiltingly adjustable back support. The FIG. 9-11 embodiment provides three modes of operation, one of which is seat supportive as in the FIG. 1-8 embodiment. The other two modes of operation include (1) a standing mode and (2) a "floating" mode where the user's seat is unsupported enabling the user to "float" while his or her back is supported on an inclined freely movable back rest and his feet push against movable foot pedals.

The present invention relates to a combination of method steps and exerciser components which co-act together to enable a user to perform cardiovascular friendly aerobic exercises while movably supported in a supine position. The exercises can be said to simulate running in soft sand.

SUMMARY OF THE INVENTION

One aspect of the present invention relates to a method of enabling a person to exercise comprising the following steps. Providing a movable body support for the exercising person which supports the seat and back of an exercising person in a supine position which allows the body of the exercising person while in supported relation to move with the movable body support with the feet of the exercising person free to be moved with respect to the movable body support. Providing a movable foot assembly separate from said body support in a position to be engaged by the feet of the exercising person supported on the movable body support. Providing for the absorption of the energy of the movement of the movable body support in a first direction away from the movable foot assembly by the exercising person supported thereon and the conversion of the absorbed energy to a movement of the movable body support with the exercising person supported thereon in a second direction toward the movable foot assembly. Providing for the damped resiliently resisted movement of the movable foot assembly caused by the engagement thereof by the feet of an exercising person moving with the movable body support in said second direction. Establishing as a result of the damped resiliently resisted movement of the movable foot assembly in said second direction, a damped resilient return movement by the movable foot assembly in the first direction, which the exercising person can translate into a movement of the movable body support in the first direction, the arrangement being such that the exercising person can control the repetition and magnitude of the movements of the movable body support by flexure of the legs at the knees.

Another aspect of the present invention relates to an exerciser comprising the following combination of components. A frame assembly. A movable body support disposed on the frame assembly and constructed and arranged to support the seat and back of an exercising person in a supine position which allows the body of the exercising person while in supported relation to move with the movable body support with the feet of the exercising person free to be moved with respect to said movable body support. A movable foot assembly coupled to the frame assembly and constructed and arranged to be engaged by the feet of the exercising person supported on said movable body support. The movable body support being mounted on said frame assembly for movement in a first direction away from said movable foot support and a second direction toward said movable foot support and being constructed and arranged to absorb the energy of a movement thereof in the first direction by a user supported thereon and to convert the absorbed energy into a movement thereof with the user supported thereon in the second direction. The movable foot assembly being constructed and arranged to yield resiliently with a damping action in response to the engagement of the feet of the exercising person moving with the movable body support in the second direction and to establish, as a result of the damped resilient yielding, a resiliently damped movement return by the movable foot assembly in the first direction which can be translated by the exercising person into a movement of the movable body support in the first direction.

Other aspects of the invention will become apparent from the following description.

BRIEF DESCRIPTION OF THE DRAWINGS

The invention will be described with reference to the following drawings, in which like numerals represent like features throughout the figures, and in which.

DETAILED DESCRIPTION OF THE INVENTION

Figure 1:
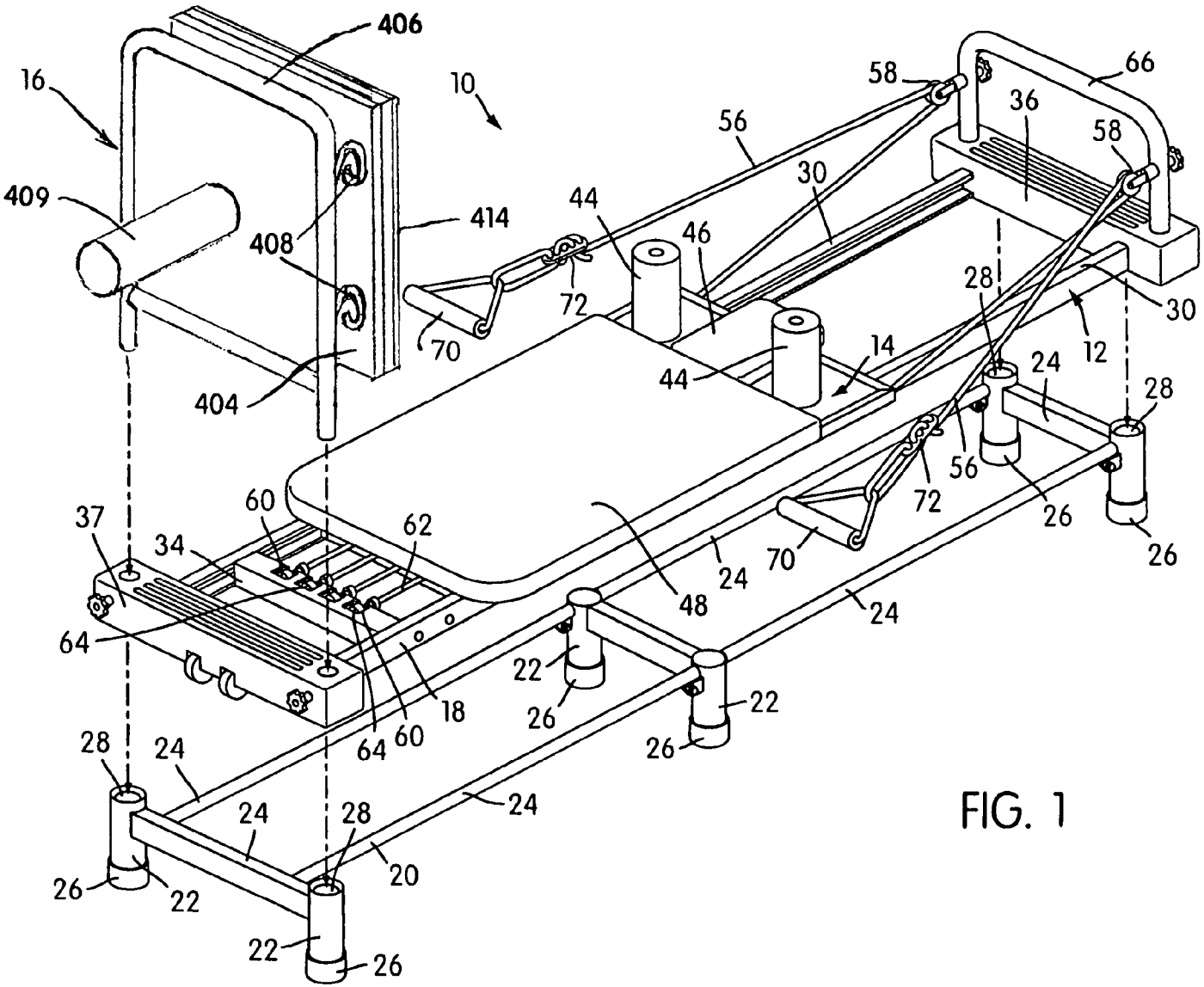
FIG. 1 is an exploded perspective view of one embodiment of an exerciser embodying the principles of the present invention.

FIG. 1 is a perspective view of an exerciser, generally indicated at 10, according to one embodiment of the invention. The exerciser 10 is generally of the type shown in U.S. Pat. Des. 382,319, which was incorporated by reference above. The exerciser 10 includes a frame assembly, generally indicated at 12, a movable body support, generally indicated at 14, disposed on the frame structure 12 in a position to support the seat and back of the user in a position which allows the body of the user while in supported relation to move with the movable body support 14 with the feet of the user free to be supported with respect to the movable body support 14, and a movable foot assembly, generally indicated at 16, constructed and arranged to be mounted on the frame structure 12 in a position to be engaged by the feet of the user while movably supported on the movable body support 14.

The frame assembly 12 includes a frame 18, which is adapted to support the movable body support 14, with the user supported thereon. The frame 18 also includes a stand 20, which is adapted to connect to the frame 18 to hold the frame 18 in a generally horizontal plane above floor level. As is shown in FIG. 1, an exploded perspective view of the exerciser 10, the stand 20 comprises a plurality of legs 22 connected at respective upper ends thereof by cross bars 24, such that the stand portion 20 is comprised of generally rectangular or trapezoidal segments having legs 22 disposed at the corners of the segments. End caps 26 of a rubber or other non-skid material may be provided at floor-contacting ends of the legs 22. Upper receptacle sections 28 of the stand 20 are adapted to receive corresponding mating structures provided on the underside of the frame 18 (not shown in the Figures), so as to operatively secure the frame 18 to the stand 20. The legs 22 of the stand 20 may be of any length that provides a convenient user height for the frame portion 18.

Depending on the embodiment, the frame 18 and stand 20 may be separable, so that the exerciser 10 can be stored easily. Additionally, the stand 20 may be omitted or sold separately, particularly if the height provided by the stand 20 is not required for the exercises that are to be performed. Moreover, it may be desirable to construct the stand 20 such that one end is wider than the other. A stand 20 with one wider end and one narrower end may be desirable if one end of the exerciser 10 requires a broader base of support to prevent lateral tipping, or if the exerciser 10 is constructed such that the stand 20 will only mate with the frame 18 if the frame 18 is in a particular orientation.

The frame 18 is comprised of two generally parallel support tracks 30, connected and braced by a number of cross members. Each of the support tracks 30 has a generally C-shaped cross-section, such that each support track 30 defines an interior track 32, in the shape of a channel, which is adapted to receive engaging portions of the movable body support 14. The engaging portions of the movable body support 14 in this embodiment are rollers 33 (shown in phantom in FIG. 2) that rollingly engage interior tracks 32. The rollers 33 are mounted to the underside of the movable body support 14 on appropriately-sized lateral projections, and allow the movable body support 14 to roll along the support tracks 30 between limiting portions of the support tracks 30. The limiting portions of the support tracks 30 define the extent of travel for the movable body support 14. In the exerciser 10, one of the limiting portions is a crossbar 34 that extends between the two support tracks 30; the other limiting portion is defined by an endpiece 36 of the frame portion 18. Alternatively, the limiting portions may simply be the ends of the grooves 32 in the support tracks 30.

Although rollers 33 are used in the illustrated embodiment, a number of bearings and other movement support structures are known in the art, and any one of these known types of bearings may be used in place of the rollers. For example, instead of rollers, blocks of low-friction material may be used, and the inside tracks 32 in the support tracks 30 may be lubricated in order to facilitate sliding movement with reduced friction.

Figure 2:
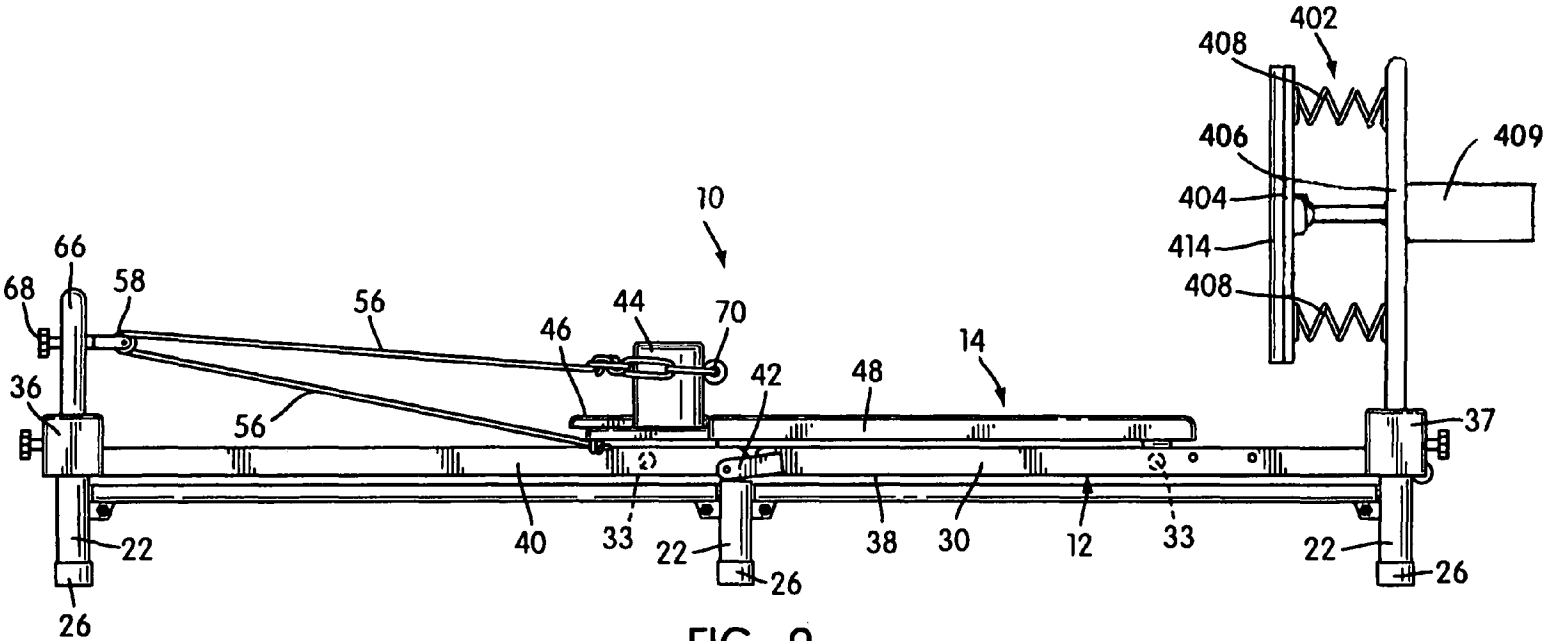
FIG. 2 is a side elevational view of the exerciser of FIG. 1.

The support tracks 30 may be continuous bars that run the length of the exerciser, or they may be comprised of sets of shorter bars which are secured together by welds or fasteners. As shown in FIG. 2, each support track is comprised of two shorter support bars 38, 40. At one end, each shorter support bar 38, 40 connects to an endpiece 36, 37 to form an end of the frame 18 of the exerciser 10. (The endpieces 36, 37 of the illustrated embodiments are bars covered with decorative plastic moldings, but they may be made in other configurations.) At the other ends of the shorter support bars 38, 40, cooperating hinge structure 42 is provided, such that the shorter support bars 38, 40 may be hingedly connected together in a manner which allows the exerciser 10 to be folded when not in use.

In alternative embodiments of the invention, the support tracks may have a substantially rectangular cross section, and a movable body support with rollers or other movement support structures may be configured so as to rest on top of the support tracks, rather than engaging inside tracks defined within them. The precise manner of engagement of the movable body support and the support tracks is not critical.

Several body-engaging components are mounted on the movable body support 14 so as to facilitate the body positioning of the user. Two padded shoulder blocks 44, one on each side of the body support 14, extend vertically, and are positioned so as to engage the upper portion of the user's torso (i.e., at the collarbone or shoulder region) when the user is lying prone or supine on the movable body support 14, so as to prevent the user from sliding relative to the movable body support 14 in a direction away from the foot support 16. The shoulder blocks 44 may be removably attached to the movable body support 14, for example, by a threaded connection.

A padded head rest 46 is also mounted on the movable body support 14. In the position illustrated in FIGS. 1 and 2, the head rest 46 is positioned such that its user-contacting surface is generally horizontal and co-planar with those of the movable body support 14. However, the head rest may be mounted on a multi-position bracket, such that its angular position may be adjusted relative to that of the movable body support so as to support the user's head in an inclined position. In addition to the head rest 46, torso pad 48 is mounted on the movable body support 14 so as to cover a substantial portion of the movable body support 14 to provide traction and comfort.

Figure 3:
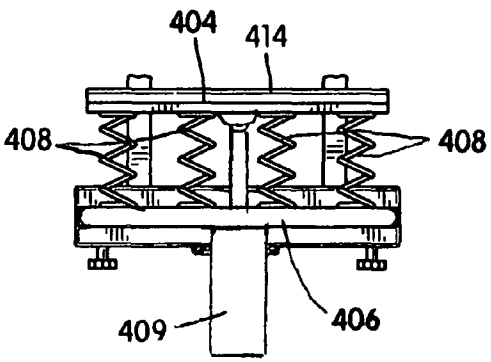
FIG. 3 is a fragmentary elevational view of the foot end of the exerciser of FIG. 1.
Figure 4:
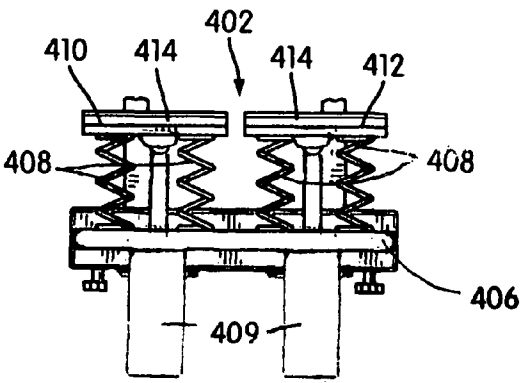
FIG. 4 is a view similar to FIG. 3 showing a variation in the construction of the movable foot assembly embodying the principles of the present invention.

When the user is lying on the movable body support 14 in a supine position with his or her head on the head rest, the user's feet are free from the movable body support 14, and extend in a direction toward the movable foot assembly 16. As can be seen in FIGS. 1-3, in one example, the movable foot assembly 16 includes a foot contact portion 404 connected to a vertically extending support 406 by compression springs 408 and a piston and cylinder damper unit 409. The foot contact portion 404 extends horizontally forward from the vertically extending support 406. Several variations of this are possible: in the top plan view of FIG. 4, a movable foot assembly 402 has two foot contact portions 410, each foot contact portion 410 being sized to accommodate one of the user's feet, whereas in the top plan view of FIG. 3 and in FIGS. 1 and 2, the foot contact portion 404 is a unitary structure sized to accommodate both feet. In each case, the foot contact portions 404 and 410 would be provided with a layer of foam or other padding material 414 to provide comfort and traction for the user's feet. Those of skill in the art will note that the exercising motion enabled by the foot support 402 is similar to the exercising motion enabled by the foot support 16.

The movable foot assembly 16 and movable foot assembly 402 are both in a position to be engaged by the feet of an exercising person supported on the movable body support 14. The body support 14 is mounted so as to absorb the energy of the movement of the movable body support 14 in a first direction away from the movable foot assembly 16, 402 by the exercising person supported thereon and to convert the absorbed energy to a movement of the movable body support 14 with the exercising person supported thereon in a second direction toward the movable foot assembly 16, 402. The movable foot support 16, 402 provides for the damped resiliently resisted movement of the movable foot assembly 16, 402 caused by the engagement thereof by the feet of an exercising person moving with the movable body support 14 in the second direction and establishes as a result of the damped resiliently resisted movement of the movable foot assembly 16, 402 in the second direction; a damped resilient return movement by the movable foot assembly 16, 402 in the first direction. The exercising person can translate this movement into a movement of the movable body support 14 in the first direction, enabling the exercising person to control the repetition and magnitude of the movements of the movable body support 14 by flexure of the legs at the knees. The movable foot assembly 16 is intended to be moved by both feet whereas the movable foot assembly 402 can be moved by either foot acting alone or both together.

Figure 5:
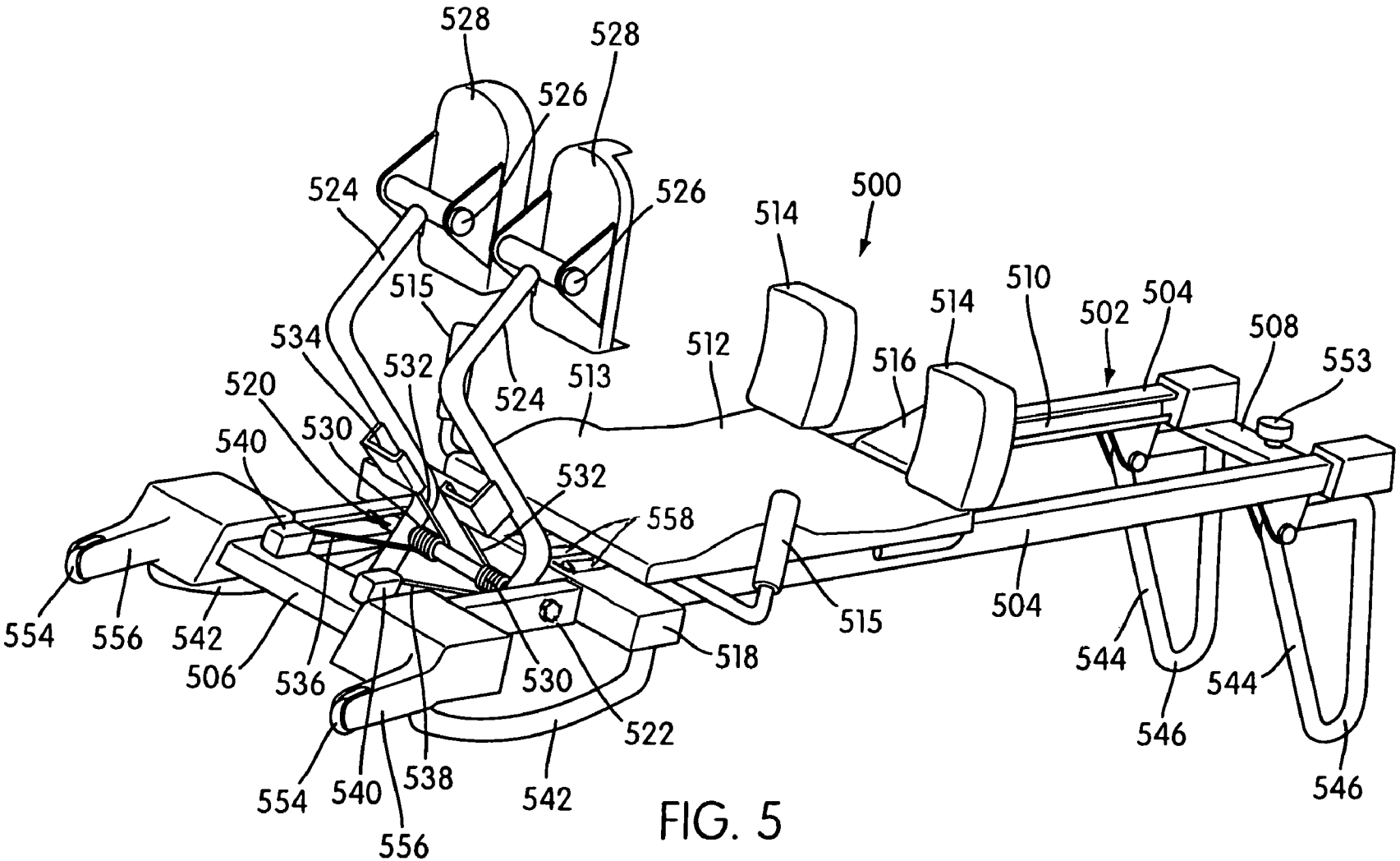
FIG. 5 is a perspective view of another embodiment of an exerciser embodying the principles of the present invention.

FIG. 5 is a perspective view of an exerciser 500 embodying the principles of the present invention. The exerciser 500 includes a frame, generally indicated at 502. The frame 502 comprises two generally parallel frame members 504 joined at respective ends by front and rear crossmembers 506 and 508. The frame members 504 define interior tracks 510 in the form of channels that extend substantially the entirety of the length of the frame members 504. A movable body support 512 is mounted for movement in the tracks 510 by means of rollers (not shown in FIG. 5). The movable body support 512 includes padded shoulder blocks 514 that extend perpendicular to the movable body support 512 and are contoured and arranged to contact the shoulder/clavicular region of the user during exercise motions. A lumbar support 513 is provided as a gently upwardly sloped portion of the movable body support 512. An adjustable head rest 516 forms a segment of the movable body support 512 beyond the shoulder blocks 514. In addition, the movable body support 512 provides two fixed L-shaped members 515 that are secured to its underside and extend outwardly and upwardly therefrom. Upper portions of the L-shaped members 515 may be used as hand grips.

Toward the front crossmember 506, an intermediate crossmember 518 extends between the two parallel frame members 504 and limits the motion of the movable body support 512 by acting as a motion stop. In accordance with the principles of the present invention, a movable foot assembly generally indicated at 520, is mounted between the two parallel frame members 504 and includes a mounting member in the form of a bolt 522 extending through each of the tracks 510 and secured in place by a nut.

The movable foot assembly 520 also includes left and right support posts 524 pivotally mounted on the bolt 522 so as to rotate about a pivotal axis extending in a transverse horizontal direction. Typically, the support posts 524 would include apertures of sufficient size to allow the bolt 522 to pass through them such that the support posts 524 are mounted for rotation about the bolt 522.

Each of the support posts 524 includes an upper transversely-extending portion 526, which would typically be welded or otherwise fixedly secured to the rest of the support post 524. Pivotally mounted on the transversely-extending portions 526 are the individual left and right foot support pieces 528, which rotate about pivotal axes defined by the transversely-extending portions 526.

The exerciser 500 is of the type that provides one foot support piece 528 for each foot, which would allow the user to exercise each one of his or her legs individually or in combination, in synchronized, alternating, or random fashion. A shift in weight or pressure from one leg to the other is possible during the exercising motions. Because the individual support pieces 528 are pivotally mounted on the transversely-extending portions 526, they can assume whatever angle is required to establish or maintain contact with the user's feet.

Figure 6:
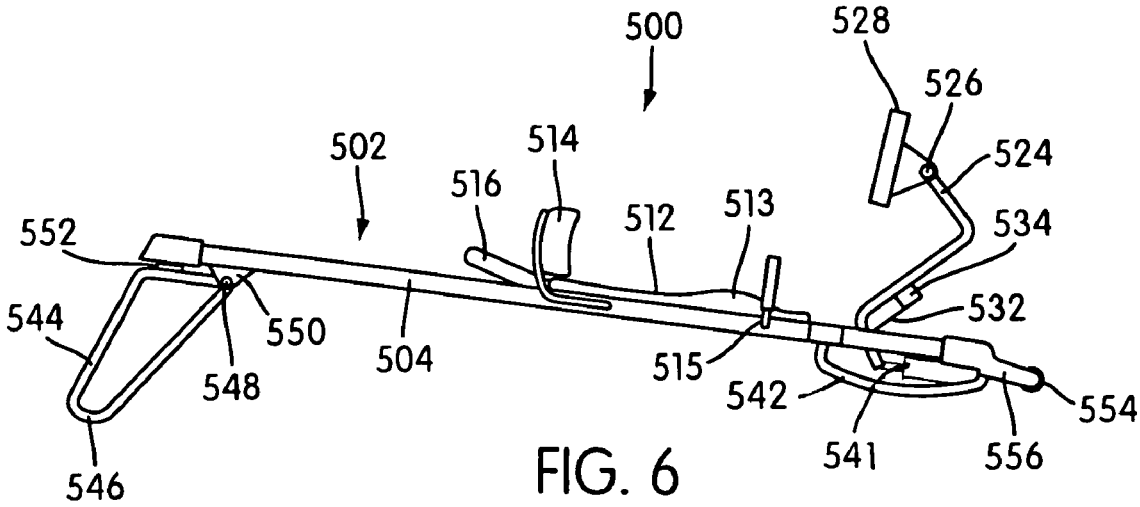
FIG. 6 is a side elevational view of the exerciser of FIG. 5 in a first operative position.
Figure 7:
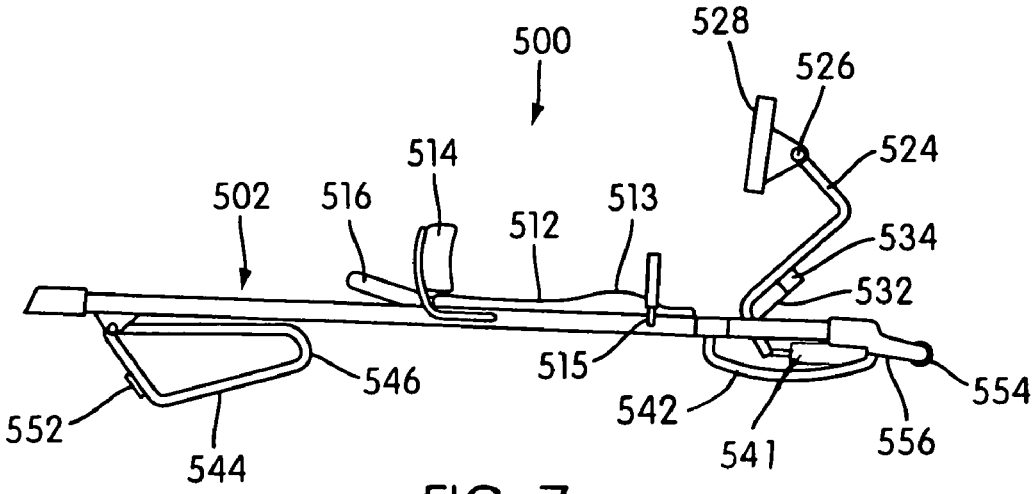
FIG. 7 is a side elevational view of the exerciser of FIG. 5 in a second operative position.

In accordance with the principles of the present invention, the movable foot assembly 520 provides for the movement of the foot support pieces 528 to be yieldingly resisted with a damping action capable of effecting a resiliently damped return movement when the moving pressure is released by the user. The resiliency is provided by two torsion coil springs 530, each of which is mounted on the bolt 522 adjacent to one of the support posts 524. As best shown in FIG. 5, a first arm 532 of each torsion spring 530 is received in a channel 534 on the support post 524; a second arm 536 of each torsion spring 530 is received in a receiving member 540 that is mounted on the front crossmember 506. With this mounting arrangement, motion of the support posts 524 in a direction toward the front crossmember 506 is resiliently opposed by the torsion springs 530. In the absence of any user-applied forces, the support posts 524 are resiliently biased toward the position shown in FIG. 5 by the torsion springs 530. The damping associated with each resiliently resisted user movement and resilient return movement is provided by left and right piston and cylinder damper units 541. As best shown in FIGS. 6 and 7, the damper units 541 are connected between lower free ends of the left and right posts 524 and undersides of a forward portion of the frame 502.

The exerciser 500 is supported on a horizontal surface such that it can be inclined at a plurality of angles. Arcuate rocker feet 542 extend on the underside of the frame 502 between the front crossmember 506 and the intermediate crossmember 518. Each rocker foot 542 can provide good contact with a horizontal surface, such as the floor or a mat, at a plurality of angles. Typically, the rocker feet 542 would be covered with a non-skid material, such as a rubber, to prevent the exerciser 500 from skidding or sliding along the horizontal surface while in use.

Two pivotable frame supports 544 support the frame 502 proximate to the rear crossmember 508. Each frame support 544 is essentially triangular with a rounded bottom portion 546 that is adapted to contact the horizontal surface. The frame supports 544 and rocker feet 542 can be seen more clearly in the side elevational view of FIG. 6. Each frame support 544 can pivot about a horizontal pivotal axis defined by a hinge pin 548 supported in a bracket 550 on the underside of the frame 502. However, in the position illustrated in FIGS. 5 and 6, the frame supports 544 are fixed in their illustrated, relatively upright position by a threaded rod that passes through the rear crossmember 508 and releasably engages a crossbar 552 that extends between the two frame supports 544 and secures them relative to one another. A user-accessible knob 553 attached to the threaded rod allows the user to remove it from or insert it into the crossbar 552, thereby securing or releasing the two frame supports 544. Once the two frame supports 544 have been released, they can be pivoted counterclockwise (with respect to the coordinate position of FIGS. 5 and 6) to assume the position shown in FIG. 7, another side elevational view of the exerciser 500.

As shown in FIG. 7, the angle between the frame 502 and the horizontal surface on which it rests has decreased. Additionally, the portions of the frame supports 544 and the rocker feet 542 that engage the horizontal surface have changed. The position of the exerciser 500 shown in FIG. 7 is a stable position and a user may exercise in it.

The exerciser 500 also includes a set of wheels 554 rotatably mounted on wheel extensions 556 that extend forwardly from the front crossmember 506. In the positions illustrated in FIGS. 6 and 7, the wheels 554 are not in contact with the horizontal surface and do not allow the exerciser 500 to be moved. However, if the user tilts the exerciser 500 so that the wheels 554 are in contact with the horizontal surface, the wheels 554 allow for easy movement of the exerciser 500.

Figure 8:
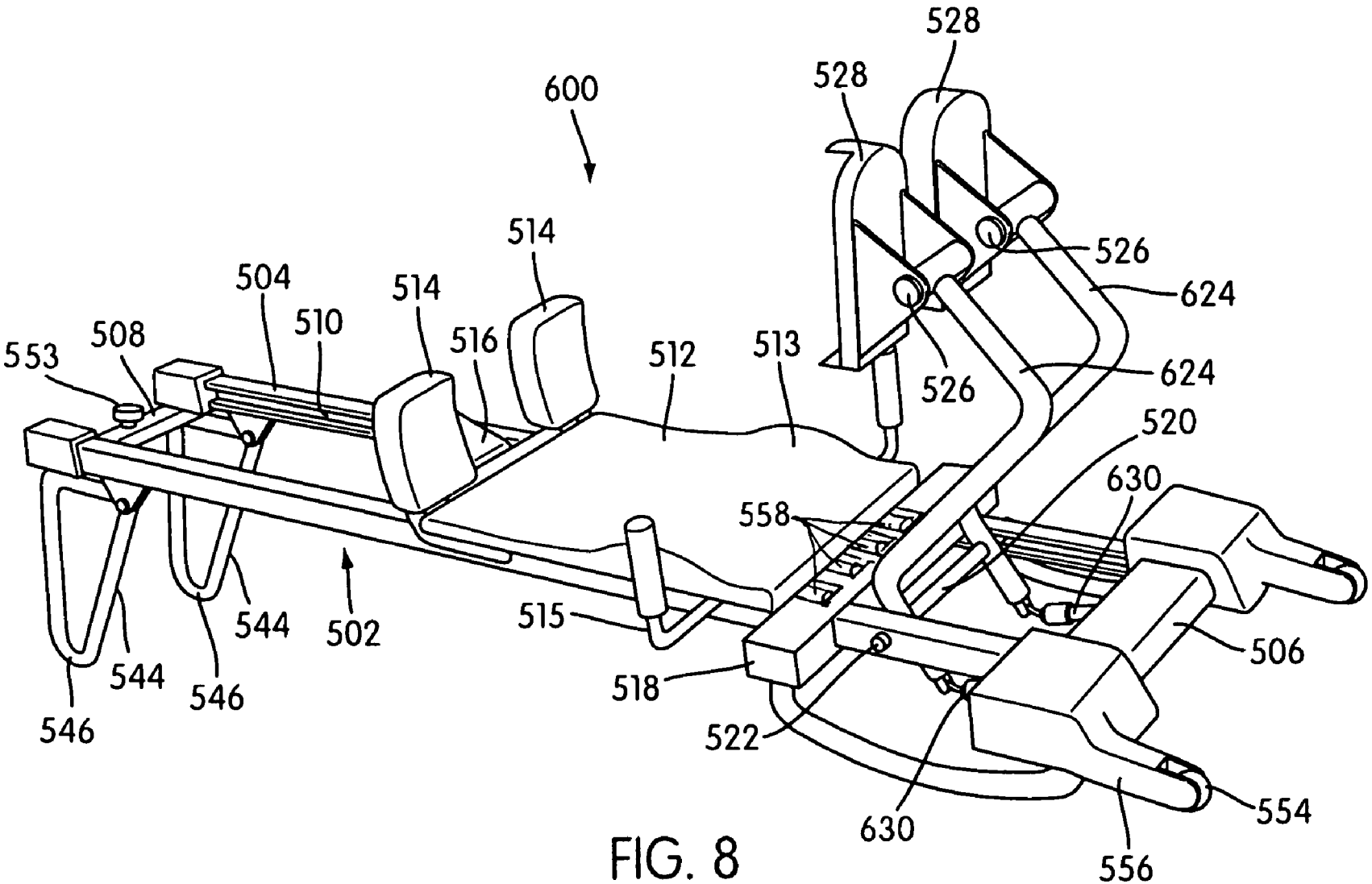
FIG. 8 is a perspective view of an exerciser according to a further embodiment of the invention.

The angle between the frame 502 and the horizontal surface on which it rests determines the degrees to which the energy of the user movement of the movable body support 512 in a direction away from the movable foot assembly 520 is absorbed and then converted into a movement of the movable body support 512 in the opposite direction toward the movable foot assembly 520. The angle adjustment system described provides for two different absorption and conversion levels. Other adjusting systems may be provided instead which provide for a multiplicity of adjusted positions within a range of positions. In the two level system described, the energy of user movement is absorbed and converted into a return movement by gravity acting on the users weight supported by the movable body support 512. Preferably, this gravitational action is supplemented by a resilient multiple removable bungee cord system of the type well known in pilates exercisers. Such a system is shown in FIGS. 5 and 8 as embodying four bungee cords 558 of different resilient resistance removably connected to the frame cross member 518 and to the movable body support 512. While both adjustments are preferred, it is within the contemplation of the present invention to utilize either without the other.

As was noted above, the resiliency of the foot supports of exercisers according to the present invention may be created in a variety of ways. FIG. 8 is a perspective view of an exerciser 600 according to another embodiment of the present invention. Many of the components of the exerciser 600 are identical to those found in the exerciser 500; therefore, the description above will suffice for those components which are designated by the same reference numerals.

Figure 9:
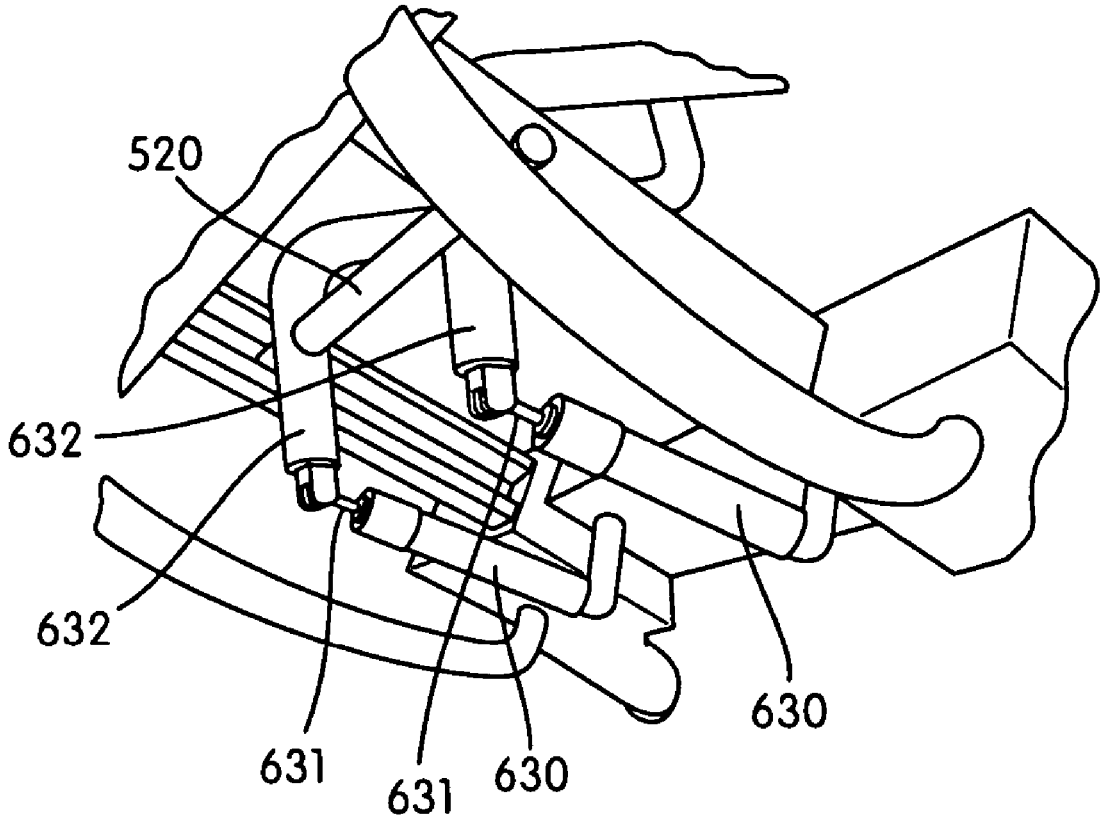
FIG. 9 is a perspective view of the underside of a portion of the exerciser of FIG. 8, illustrating the movable foot assembly of the exerciser.

The primary difference between the exerciser 500 and the exerciser 600 is in the resilient damping system connected to the support posts 624. Instead of torsion springs 530 and damper units 541, the exerciser 600 uses two combination spring and damper units 630 mounted on the underside of the front crossmember 606. FIG. 9 is a perspective view of the underside of the exerciser 600 proximate to the front crossmember 606, showing the units 630 and their attachment in more detail. As before, the piston rods 631 of the units 630 are pivotally connected to short lever arms 632, forming lower free ends of the support posts 624.

With the units 630 connected to the lever arms 632 below the foot support mount member 520 (about which the support posts 624 pivot), the overall arrangement is such that a movement of the support posts 624 forward (clockwise with respect to FIG. 8) results in an extension of the piston rods 631 of the units 630. The action of the units 630 is such that resilient restorative force is provided to retract the shaft 631 of the unit 630 and thereby to return the support post 624 to its original position (i.e., that illustrated in FIG. 8) when the shaft 631 of the unit 630 is extended.

As those of skill in the art will appreciate, spring and shock absorber units 630 could also be attached to points on the support posts 624 that are above the foot support mount member 520, in which case the "sense" of the motion would be reversed and the shaft of the unit would need to retract upon forward motion of the support post 624 and resiliently extend to return the support post 624 to its original position. Other types of connections between the support posts 624 and the units 630 may also necessitate motion of the "sense" opposite that illustrated in FIGS. 8 and 9.

The particular type and internal arrangement of the units 630 is not critical to the invention. Many types of spring and shock absorber units are known in the art and may be used or adapted for use in exercisers according to the present invention. For example, U.S. Pat. Nos. 5,622,527 and 5,071,115 disclose exemplary types of hydraulic cylinders that may be used as shocks in exercisers according to the present invention, and the disclosure in those two references that pertains to hydraulic cylinders is hereby incorporated by reference.

The units 630 of the exerciser 600 would generally comprise a damper (i.e., hydraulic or gas cylinder with restricted orifices to control the flow between chambers in the cylinder or across the piston) in parallel with a conventional compression or tension spring. The spring may be placed inside or outside of the cylinder. If the spring is outside of the cylinder, it may be axially coextensive with the cylinder.

Figure 10:
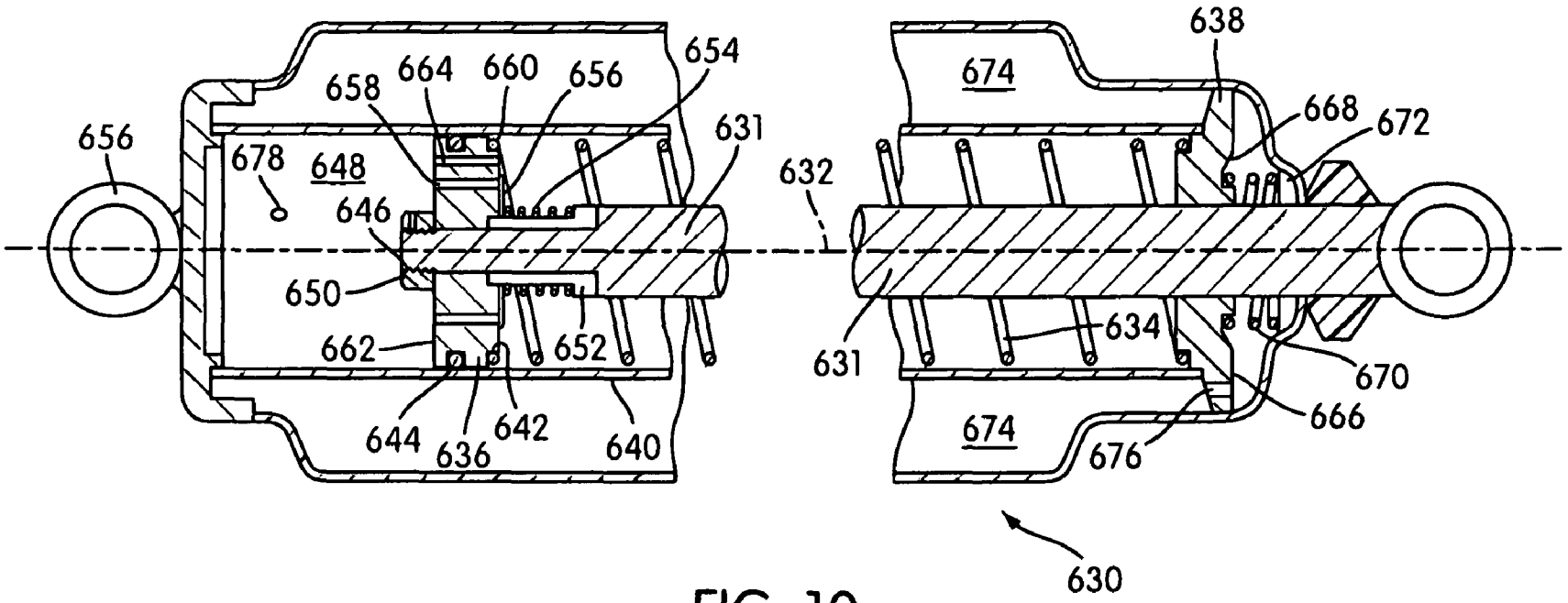
FIG. 10 is a longitudinal cross-sectional view of a spring and shock absorber unit suitable for use in the exerciser of FIG. 9.

FIG. 10 is a longitudinal cross-sectional view of one suitable type of unit 630 that may be used in the exerciser 600 of the present invention. The unit 630 combines resistive structure and biasing structure in a single cylinder having a central axis 632. The unit 630 holds a compressible coil spring 634 between the piston 636 and the cylinder end piece 638 of the cylinder 640, which biases the shaft 631 to resiliently retract and return to the position shown in FIG. 19 when extended.

Piston 636 is shown as having a peripheral shoulder 642 within which spring 634 is registered to maintain its alignment within cylinder 640. The piston 636 includes a peripheral O-ring 644 for sealing the piston within the cylinder 640. The piston 636 is shown fixed to a threaded 646 reduced diameter portion 648 of shaft 631 by a locknut 650. A collar 652 is fitted on reduced diameter portion 652, and retains a check valve spring 654 on the reduced end 656. The spring 654 holds washer 656 against the piston 636 to overcover the orifices 658, preventing oil flow through the orifices 658 when the pressure on the washer side 660 of the piston is higher than the pressure on the opposite side 662. Orifices 664 permit fluid flow in both directions.

Cylinder end piece 666 is attached to the cylinder 640 as by welding. The end piece 666 is shown with a circular slot 668 in its exterior face into which seal spring 670 fits. Seal spring 670 maintains pressure on shaft seal 672 to prevent leakage from the outer chamber 674. An orifice 676 in the end piece 638 permits pressure equalization across the end piece 638 so that seal 672 does not become overpressurized. An orifice 678 in cylinder 640 permits pressure equalization between the cylinder 640 and chamber 674.

The exercisers 500, 600 illustrated in FIGS. 5-9 are of the sort that might be used primarily in the home, because they are relatively lightweight, simple in construction, and capable of being moved and stored. However, certain adaptations to the exercisers 500, 600 are advantageous if the exercisers are to be used in a professional setting. For example, in a professional setting, it is advantageous if the damping/resistance provided by the units 630 can be user controlled so as to provide a more or less intense workout depending on the user's fitness level. This may be accomplished, for example, using the type of unit shown in U.S. Pat. No. 5,071,115. In more "advanced" embodiments, the variable restriction valve or other control structure within the unit 630 could be placed under computer control and manipulated electrically (e.g., in the case of a solenoid valve) or electromechanically/hydraulically (e.g., in the case of a traditional restricted orifice). In either case, an interface would be provided, allowing the user to select the amount of resistance. Additionally, instead of the two position frame supports 544, the exercisers 500, 600 could include supports that are hydraulically or electromechanically controllable to produce a user desired incline angle from a continuous range of possible incline angles. If the exerciser 500, 600 includes both variably adjustable resistance levels and a variably adjustable incline, the controls and interface for the two features, as well as the control lines or hydraulic fluid lines may be integrated into one set of controls and conduits.

The exercisers according to the present invention provide several advantages. First, the user can perform exercises in a supine or prone position, which is usually at least perceived to be more comfortable by the user. Second, the type of exercises that can be performed on exercisers according to the invention may have cardiovascular, strength, and flexibility benefits. Third, as was described above, certain known types of exercises, such as Pilates exercises, may be performed on exercisers according to the invention, if desired by the user.

Although the invention has been described with respect to certain embodiments, those of ordinary skill in the art will realize that modifications may be made within the scope of the invention.

What is claimed is:

1. An exerciser comprising:

a frame assembly;

a movable body support disposed on said frame assembly and constructed and arranged to support the seat and back of an exercising person in a supine position which allows the body of the exercising person while in supported relation to move with the movable body support with the feet of the exercising person to be free to be moved with respect to said movable body support; and a movable foot assembly coupled to said frame assembly and constructed and arranged to be engaged by the feet of the exercising person supported on said movable body support, said movable foot assembly including an elastic structure and a damper structure, said movable body support being mounted on said frame assembly for movement in a first direction away from said movable foot support and a second direction toward said movable foot support and being constructed and arranged to absorb the energy of a movement thereof in the first direction by a user supported thereon and to convert the absorbed energy into a movement thereof with the user supported thereon in said second direction; and said movable foot assembly being constructed and arranged to yield resiliently with a damping action by the damper structure in response to the engagement of the feet of the exercising person moving with the movable body support in said second direction and to establish, as a result of the damped resilient yielding, a resiliently damped return movement by the elastic structure in said first direction which can be translated by the exercising person into a movement of said movable body support in said first direction.

2. The exerciser of claim 1, wherein the movable foot assembly comprises left and right resiliently movable individual foot support portions.

3. The exerciser of claim 2, wherein said left and right resiliently movable individual foot support portions are separately pivotally mounted on said frame assembly for rotation about a common generally horizontal pivotal axis.

4. The exerciser of claim 3, wherein the elastic structure comprises left and right springs and the damper structure comprises a shock absorber, said left and right resiliently movable individual foot support portions are resiliently biased by the left and right springs and the shock absorber units respectively connected between said frame assembly and coupled to said left and right resiliently movable individual foot support portions respectively.

5. The exerciser of claim 4, wherein said left and right springs and shock absorber units each include a cylinder, a piston slidably mounted in said piston for movement in opposite axial directions, a piston rod fixed to said piston and extending outwardly in sealed relation with respect to one end of such cylinder, a compression spring operatively mounted in said cylinder between said piston and said one end of said cylinder so as to bias said piston toward an opposite end of said cylinder, each of said units also having control surfaces for containing hydraulic fluid within said cylinder and controlling movement of said hydraulic fluid within said cylinder on opposite sides of said piston during the movement thereof in either direction.

6. The exerciser of claim 1, wherein said frame assembly includes a set of generally parallel tracks constructed and arranged to be rollingly engaged by rollers provided on said movable body support.

7. The exerciser of claim 1, wherein said movable body support is rollingly movable along tracks in a generally horizontal plane.

8. The exerciser of claim 1, wherein said frame assembly includes a stand structure constructed and arranged to support tracks.

9. The exerciser of claim 8, wherein said stand structure is constructed and arranged to support said tracks in a generally inclined plane above a horizontal surface.

10. The exerciser of claim 9, wherein said stand structure is movable between positions to support said tracks selectably in different inclined planes above a horizontal surface.

11. The exerciser of claim 10, wherein said stand structure comprises legs pivotally mounted on said tracks for rotation about generally horizontal pivotal axes, said legs having different lengths at different pivotal positions.

12. The exerciser of claim 9, wherein said stand structure defines a number of support positions so as to allow said tracks to be mounted on said stand structure in any one of the number of support positions, each of the number of support positions defining an inclined plane above the horizontal surface.

13. The exerciser of claim 1, wherein the absorption of the energy of movement of the movable body support is by movement of the exercising person supported on the movable body support against the influence of gravity; and wherein the conversion of the energy of movement of the moveable body support is by movement of the exercising person supported on the movable body support under the influence of gravity.

14. The exerciser of claim 1, further comprising one or more elongated tensile resilient resistance elements selectively coupled between said frame assembly and said movable body support;

wherein said elongated tensile resilient resistance elements absorb the energy of movement of said moveable body support with the exercising person supported thereon in said first direction and convert it to the movement thereof with the exercising person supported thereon in said second direction.

15. The exerciser of claim 1, said movable body support further comprising hand grips mounted thereto, said hand grips being arranged on said movable body support such that they may be gripped by the hands of the exercising person.

16. The exerciser of claim 1, further comprising a set of pull cords, said pull cords being connected to said movable body support at respective first ends thereof, having grips constructed and arranged to be engaged by the exercising person at respective second ends thereof, and being trained between said first and second ends over a set of pulleys carried by the frame assembly;

the arrangement being such that a movement in the second direction of said pull cords by the arms of the exercising person engaging said grips is translated into a movement of said movable body support in said first direction.

17. An exerciser comprising:

a frame assembly including two generally parallel tracks and stand structure allowing said frame assembly to be supported along an inclined plane;

a movable body support movably mounted on the generally parallel tracks of said frame assembly, the movable body support being constructed and arranged to support the body of an exercising person in a position which allows the body of the exercising person to move with the movable body support while enabling the feet of the exercising person to be free to be moved with respect to said movable body support; and movable foot supports coupled to said frame assembly and constructed and arranged to be engaged by the feet of the exercising person supported on said movable body support, said movable body support being mounted on said generally parallel tracks for movement in a first direction away from said movable foot supports and a second direction toward said movable foot supports and being constructed and arranged to absorb the energy of a movement thereof in the first direction by the exercising person supported thereon and to convert the absorbed energy into a movement thereof with the exercising person supported thereon in said second direction; and said movable foot supports being constructed and arranged to yield resiliently in response to engagement of the feet of the exercising person moving with the movable body support in said second direction and to establish, as a result of the resilient yielding, a bouncing movement by the movable foot supports in said first direction which can be translated by the exercising person into a movement of said movable body support in said first direction.

18. The exerciser of claim 17, wherein said movable foot supports are resiliently biased by springs mounted on said frame assembly and coupled to said movable foot supports.

19. The exerciser of claim 17, wherein said movable foot supports are resiliently biased by shocks mounted on said frame assembly and coupled to said movable foot supports.

20. The exerciser of claim 17, wherein said stand structure is pivotably mounted on said frame assembly for movement about a generally horizontal pivotal axis.

21. The exerciser of claim 20, wherein said stand structure pivots between upper and lower supporting positions.

22. The exerciser of claim 21, wherein said frame assembly further comprises securing structure to secure said stand structure in at least one of said upper and lower supporting positions.

* * * * *